United States Patent [19]

Jones

[11] Patent Number: 4,499,127

[45] Date of Patent: Feb. 12, 1985

[54] PICTURE-BACKING FOIL WITH DEPRESSIONS AND COLORING MATERIALS THEREIN

[76] Inventor: William A. Jones, P.O. Box 189, Everett, Wash. 98201

[21] Appl. No.: 284,939

[22] Filed: Jul. 20, 1981

[51] Int. Cl.[3] ..... B44D 2/00

[52] U.S. Cl. ..... 428/14; 428/159; 428/319.1; 428/913.3

[58] Field of Search ..... 428/13–30, 428/159–160, 173, 319.1; 434/81, 82, 84, 85–87; 427/287; 40/160, 563

[56] References Cited

U.S. PATENT DOCUMENTS

| | | | |
|---|---|---|---|
| 1,996,539 | 4/1935 | Dufay | 428/30 |
| 2,577,320 | 12/1951 | Fenyo | 428/905 X |
| 2,875,543 | 3/1959 | Sylvester et al. | 428/30 |
| 2,980,533 | 4/1961 | Charlton | 428/13 X |
| 3,062,698 | 11/1962 | Aykanian | 428/318.4 X |
| 3,070,476 | 12/1962 | Miller | 428/160 |
| 3,099,544 | 7/1963 | Sheesley | 427/287 X |
| 3,399,101 | 8/1968 | Magid | 428/159 |
| 3,506,533 | 4/1970 | Berner | 428/319.1 X |
| 3,912,842 | 10/1975 | Swartz | 428/207 X |
| 3,943,648 | 3/1976 | Sterne | 428/30 X |
| 3,963,847 | 6/1976 | Norgarg | 428/161 X |
| 4,325,177 | 4/1982 | De Poorter | 428/49 X |

*Primary Examiner*—Henry F. Epstein

*Attorney, Agent, or Firm*—Paul H. Gallagher

[57] ABSTRACT

Foil, (aluminum) is secured to a plastic backing member (Styrofoam), and depressions made in the front face of the foil, which extend into the backing member, and are held by those members. The depressions are made in a pattern to form a picture, and plastic materials are placed in the depressions, that are transparent, of different colors, and of convex shape, acting as lenses. The plastic material includes casting resin, thixotropic thickening material, a dye, and a catalyst. Another form includes a rigid backing member and a stencil secured there to, and foil over the stencil, and the depressions are made in the foil, following the pattern in the stencil. Another embodiment includes a shaping form having raised elements and foil thereover; both are placed in a mold, and plastic material in fluent form placed over the foil and enabled to expand, the plastic material then constituting the backing member. This forces the foil against the shaping form, forming the depressions in the foil, and backing member, and these together as a unit are removed from the mold, and the picture completed as in the first cases. In a further form, plastic material is placed on a glass panel to form the pictorial representation, the glass panel is placed in the open front side of a box which is otherwise closed and lined with dark velvet. The glass panel is placed with the pictorial representation disposed inwardly.

14 Claims, 17 Drawing Figures

Fig. 3.
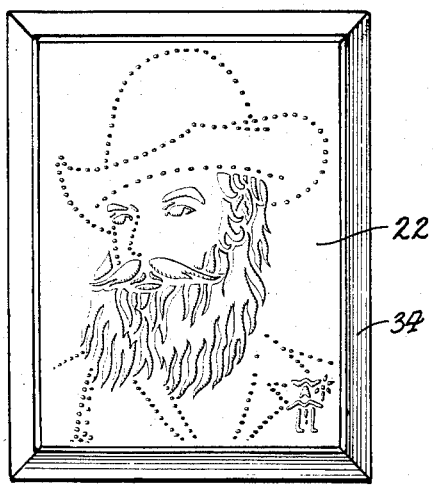
Fig. 4.
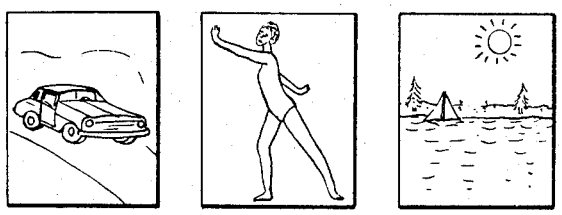
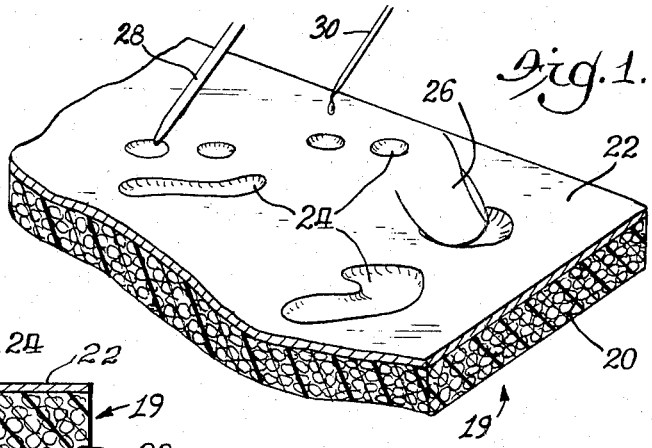
Fig. 1.
Fig. 2.
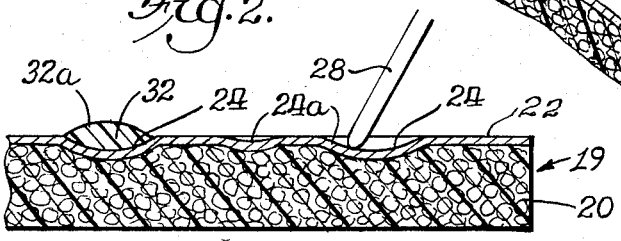
Fig. 5a.
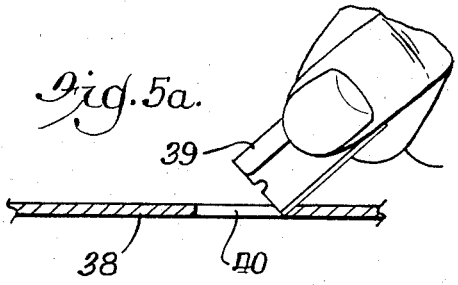
Fig. 5.
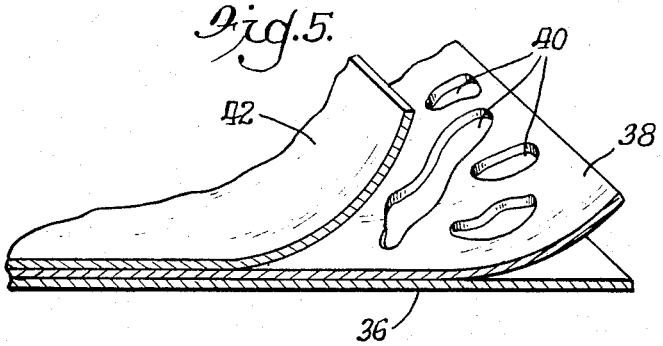
Fig. 6.
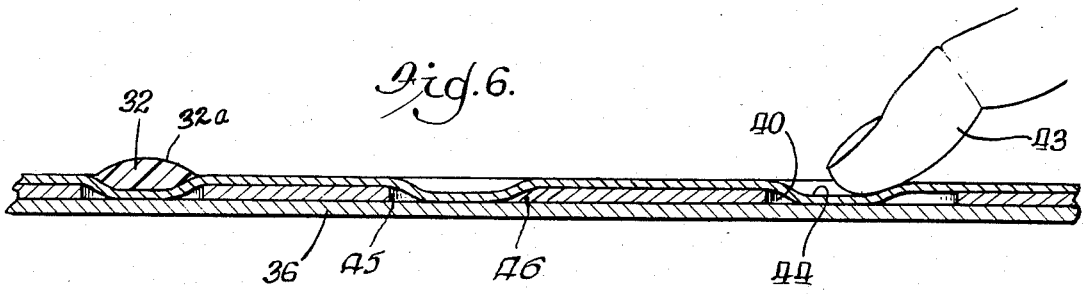

PICTURE-BACKING FOIL WITH DEPRESSIONS AND COLORING MATERIALS THEREIN

OBJECTS OF THE INVENTION

A broad object of the invention is to provide a new kind of picture and method of making it.

A more specific object is to provide such a picture and method, wherein the following features and advantages are accomplished:

1. A person's artistic talents can be brought into play to great effect.

2. Very unusual effects are achieved, by utilizjng light-transmitting and light-reflecting properties, and a variety of colors.

3. The picture is made with readily accessible and inexpensive materials. 4. The picture is extremely effective for attracting and holding the attention of observers.

DESCRIPTION OF CERTAIN PREFERRED EMBODIMENTS

In the drawings:

FIG. 1 is a fragmentary perspective view, partially in section, of certain main components of the picture;

FIG. 2 is a sectional view of a picture indicating the manner of forming depressions, and showing filler material in the depressions;

FIG. 3 is a face view of a picture made according to the invention;

FIG. 4 is a face view of a plurality of pictures indicating widely different kinds of representations;

FIG. 5 is a fragmentary perspective view of certain main components of another form of the invention;

Figure 7:
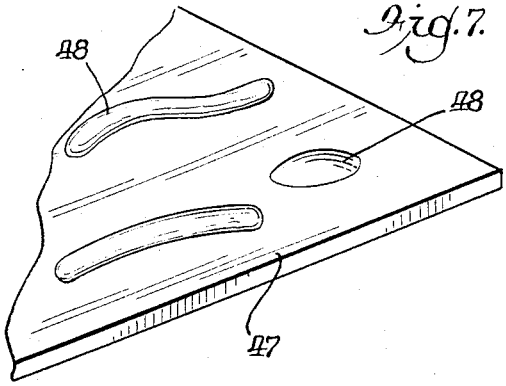
Figure 8:
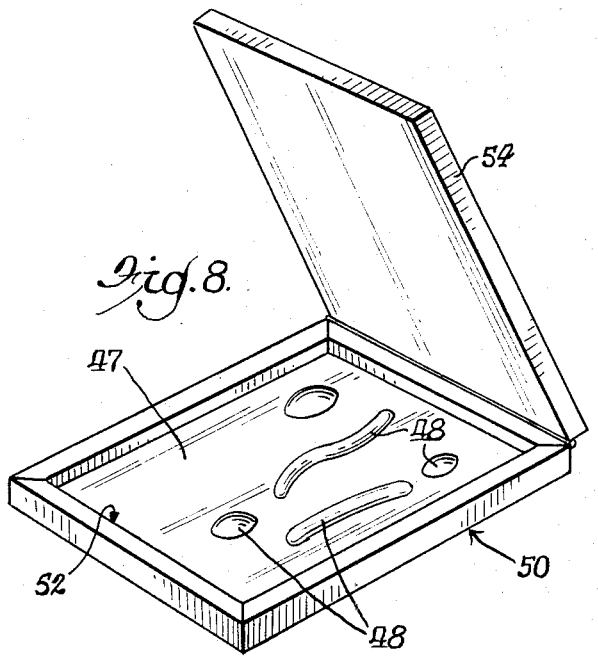
Figure 9:
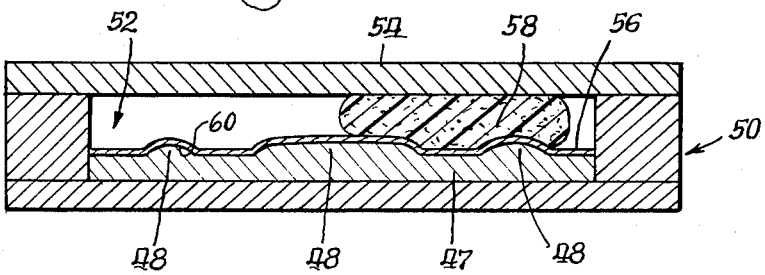
Figure 10:
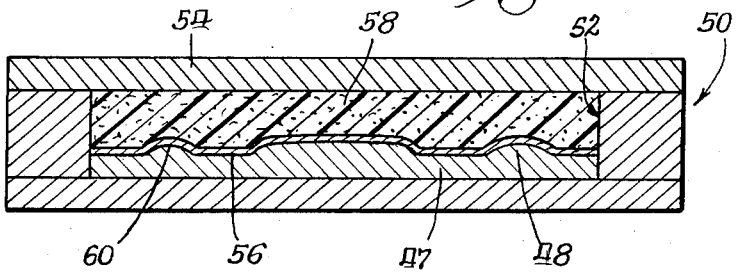
Figure 11:
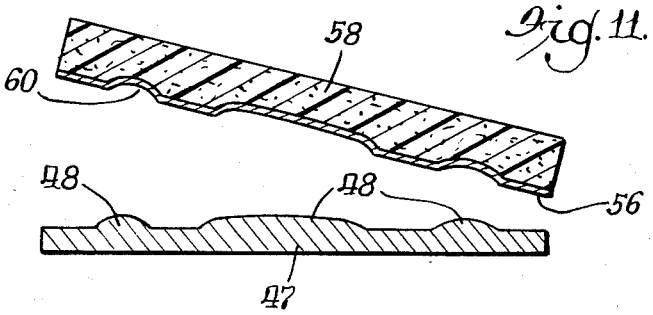
Figure 12:
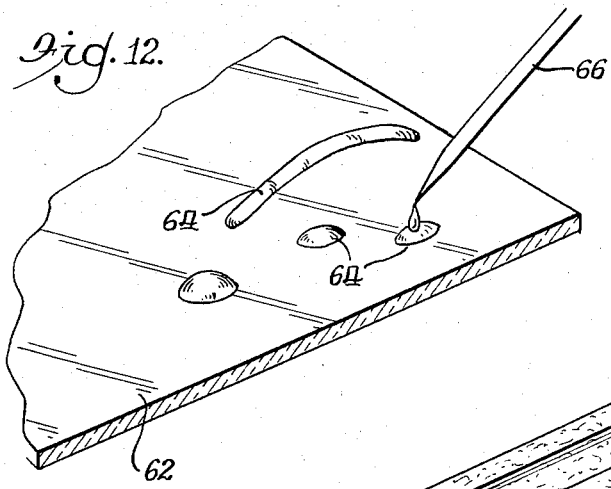
Figure 13:
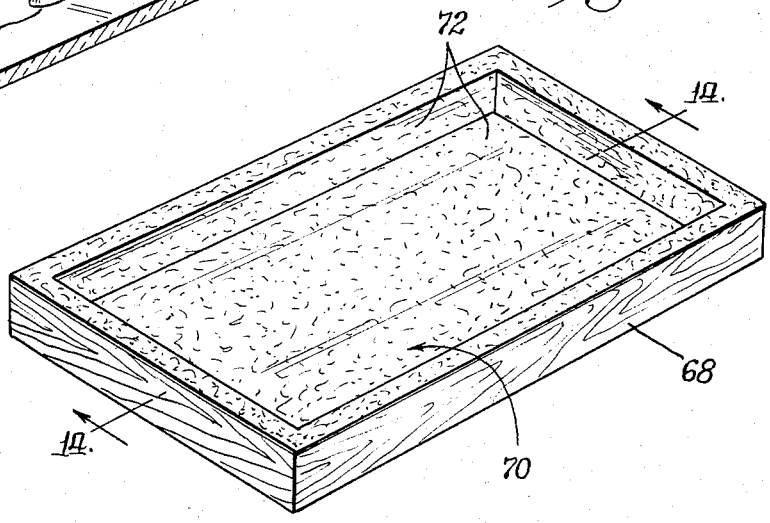
Figure 14:
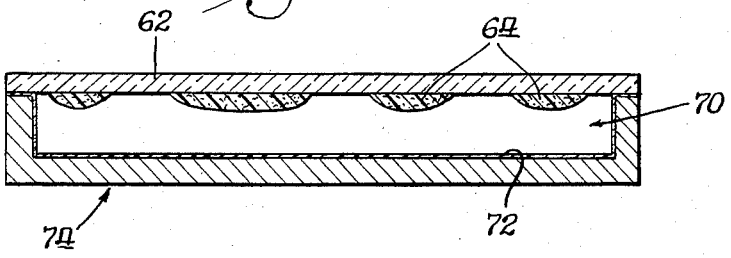
Figure 15:
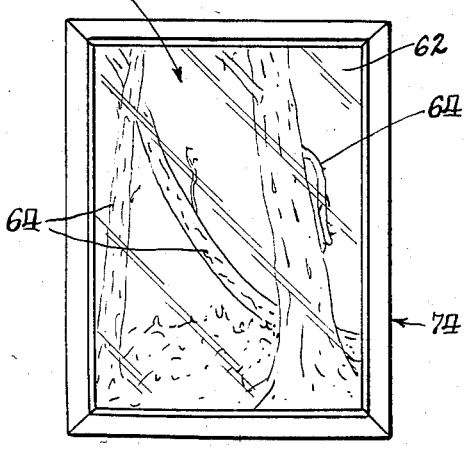

FIG. 5*a* indicates the manner of cutting the stencil of FIG. 5;

FIG. 6 is a sectional view of the material of FIG. 5 but with the layers that are incorporated therein laid down in flat superposed position;

FIG. 7 is a fragmentary perspective view of a shaping form used in producing certain components of a further embodiment of the invention;

FIG. 8 is a perspective view of a mold in which the shaping form of FIG. 7 is placed, the mold being shown with the cover in open position;

FIG. 9 is a sectional view of the mold of FIG. 8 in closed position with the shaping form therein and foil over the shaping form, and a quantity of plastic foam material over the foil;

FIG. 10 is a view similar to FIG. 9 but with the foam material after having expanded, and filling the cavity;

FIG. 11 shows the shaping form, and the completed component of the foil and backing member, removed from the mold and indicating the step of separating them;

FIG. 12 is a fragmentary perspective view of a component of a picture of a still further embodiment of the invention;

FIG. 13 is a perspective view of a box, to form a picture frame, to which the panel of FIG. 11 is applied;

FIG. 14 is a sectional view oriented according to line 14—14 of FIG. 13, and showing the box of that figure, and the panel of FIG. 12 thereon;

FIG. 15 is a face view of a picture made by the steps represented in FIGS. 12–14, and FIG. 16 is a diagrammatic view of a picture of any of the foregoing forms in place on a wall, and representing the position of a light illuminating it.

Referring in detail to the drawings, in FIGS. 1–3, a backing member or layer 20 is provided, which is preferably of styrofoam, semi-rigid in that it is self-sustaining in shape, but it is pliable so that it can be shaped or formed, within certain limits. This characteristic will be referred to hereinbelow in connection with making depressions therein.

The backing member 20 is selected in size and proportions according to the dimensions of the desired final picture. A sheet of foil or second layer 22 is selected of the same size as the backing member. The foil is preferably aluminum, but other materials may be used instead, that are highly reflective, a characteristic of significance and importance in the invention. The foil is preferably on the order of 0.003 inches thick, although of course it is not limited to this dimension. Foil known as kitchen foil is satisfactory. The foil is adhered to the backing member 20 by any suitable adhesive material, many of which are known and on the market, and those two elements form a panel 19.

Following the foregoing steps, depressions or indentations 24 are formed in the face of the foil, by any suitable instrumentality such as the finger as indicated at 26, a stylus 28, or a toothpick 30, etc. If desired, the intended picture may first be sketched on the foil. Pressure is applied to the face of the foil until the depression of desired size and depth is made, this pressure displacing the material of the backing member also, whereby the depression extends into that layer as well. Foil, as is well known, is easily bent and deformed, adapting itself readily to the formation of the depressions. The material of the backing member and of the foil, after the formation of the depressions, takes a set shape, and hold the depressions so formed. The main expanse of the foil, other than that in the depressions, is held against deformation such as wrinkling, by its attachment to the backing member throughout its area, and the semi-rigidity of the backing member holds the foil in its original first form, such as planar shape.

It will be understood that the depressions 24 may be of any size, shape and depth, and in producing any picture, selected ones of such configurations are utilized. Different conformations, both in outline shape and size, are shown in FIG. 1, and different depths are shown at 24*a* in FIG. 2. The depressions 24 are thus formed according to the desired picture, and FIG. 3 shows in face view such a picture in portrait form. These depressions also result in different texture as will be referred to hereinbelow. To complete the picture, filler material 32 is deposited in the depressions, being so deposited in a specific manner referred to hereinbelow. The filler material is a mixture of several ingredients. It includes a casting resin, a thixotropic material, a dye, and a catalyst. The casting resin, a polyester, chemically inert, in liquid form, and ciear, does not harden by evaporation. The thixotropic material, is a silicon in the form of a powder, and is added to the casting resin to thicken it. It is chemically inert in the casting resin. The dye is then added, this being preferably transparent. Finally the catalyst is added to harden it, this being preferably a methyl ethyl ketone. The mixture thus prepared is transparent. All of the foregoing materials are now on the market, and known to artists and craftsmen. The material remains in pliant form for a time, enabling it to be applied and worked, but it hardens after a suitable period, such for example as 15–20 minutes. Accordingly only a small amount of the material need be prepared at a time.

The filler material 32 is placed in such quantity as to fill the depressions, and preferably to also extend above the top surface of the foil, as represented at 32*a* in FIGS. 2 and 6, which presents an added effect in that it acts as a lens. Other materials of course may be used as a casting resin, such as polyurethane and epoxy although these are not as satisfactory as polyester. The material adheres of course to the foil, as it hardens and sets, so that the resulting picture may be put in any position without the material falling off.

Due to the lens shape of the material, at 32*a*, a very unusual effect is provided by the picture. The light reflects from the overall picture as a whole, not only reflecting from the outer surface of the lens shaped material, but penetrating through the material and reflected from the back surface thereof, and from the surface of the foil in the depression as well, and out to the observer. Other features and techniques may be utilized, such as rendering the surface of the foil, between the depressions, non-reflective or relatively so, so that the principal portion of the reflected light is from the plastic materials, and not, or less so, from the general surface of the layer of the foil. The plastic materials are often of different colors, but it is to be pointed out that the invention also covers the use of a single color in a picture. The lens shape plastic material particles 32*a* produce a "jewel" effect which is extremely attractive.

Another characteristic of the picture results from the different sizes of depressions utilized to form the picture. For example, relatively large depressions would be made by the finger, smaller ones by a stylus of any desired size and extremely small depressions by a toothpick or other such small article. These different sized depressions, and correspondingly different sized particles of plastic material, form an unusual effect, both when a number of uniform size are together in each of different areas, or when those of various sizes are intermixed throughout. This difference in sizes, and even in colors, of the picture elements produces a texture to the picture, and a most extremely unusual effect.

The picture completed according to the foregoing, which includes the backing member 20, the foil 22, and the plastic materials 32, form a rigid and complete picture which may be mounted as is, or in a suitable frame 34 as in FIG. 3.

The picture of a man of FIG. 3 shows to good and unusual effect the use of the elements 32 of various kinds, different sizes and shapes, and placement and grouping, spacing apart and variation of the extent of the spacing and interconnection between some of them. As noted above, they may be of different colors, and FIG. 3 gives a good indication of the effect of different colors, such as the skin, the beard, the clothes including hat, Unusual texture is also produced.

FIG. 4 is a diagrammatic illustration of several pictures showing different characters or pictorial representations, to indicate the wide range of the applicability of the invention. The pictures may include people, scenes, machines, etc. In such cases as these also, unusual effect is produced.

Reference is made next to FIGS. 5, 5*a* and 6 showing a modified form of the invention. In this form a backing member 36 is provided, which may be any of various materials, such as cardboard, wood, etc., preferably rigid and self-sustaining. A second layer 38 is provided with a plurality of cut-outs 40 therein, which may be cut by a suitable tool such as a knife or razor blade 39, as shown in FIG. 5*a*, forming a stencil. These cut-outs are of such size, shape, proportions, and dimensions as desired, according to the formation of the depressions as described above, to produce a picture, a pictorial representation, or a pattern. Next a foil 42 which may be similar to the foil 22 above, is put over the stencil, and the three layers are secured together in flat superposed position, and adhered by a suitable adhesive material. Then the foil is depressed into the cut-outs or openings 40 as by the finger 43, thus forming depressions 44, corresponding to the depressions 24 above. The cut-outs 40 may have straight side edges 45, or the edges may be tapered or inclined as at 46, to facilitate forming the indentations in the foil. The plastic material, such as 32 referred to above, is then placed in the depressions in the same manner as described above.

The end result of forming the picture or shaping the foil, according to the present form of the invention, is the equivalent of that described above in connection with the first embodiment, except that in the present case the depressions 44 may be larger than in the previous case, because of the difficulty in making small cut-outs 40 in the stencil, since as will be recalled in the previous case, certain depressions are small because made by a stylus or toothpick.

FIGS. 1–11 illustrate another embodiment of the invention. In this instance, a shaping form 47 is provided, of rigid material, and formed thereon are raised elements 48 forming a picture or pattern to be produced. The elements 48, being embossments or positive elements, are utilized to form the depressions desired in the foil and backing member, and therefore the picture or pattern formed on the shaping form is made in reverse. The shaping form 47 is placed in a mold 50 having a cavity 52 and a cover 54, and a foil 56 is placed over the form, and a quantity of plastic material 58 such as Styrofoam is placed over the foil. FIG. 9 represents the Styrofoam 58 in relatively small quantity, less than the volume of the cavity, and it is permitted to expand, whereby it fills the cavity, and forces the foil down against the shaping form, and the raised elements 48 form depressions or indentations 60 on the under side of the foil. The material 58 adheres to the foil, and after the completion of the foregoing steps, the material 58 and the foil together form a unitary article and is lifted out of the cavity, with the form, and separated from the form as represented in FIG. 11. The compound article consisting of the material 58 and foil 56 constitutes an article equivalent of the backing member 20 and foil 22 of the first embodiment. The picture is then completed according to the description above in connection with the first embodiment.

FIGS. 12–16 illustrate still another embodiment of the invention. In this embodiment a glass panel 62 is provided, and plastic material 64 the equivalent of the plastic material 32 referred to above is deposited on the glass panel in a pattern to represent the desired picture, also in accordance with the foregoing description. The plastic material may be applied by any suitable instrument such as indicated at 66 in the use of which the material 64 falls off in droplets.

The glass panel 62 is then mounted in or on a box 68 which has an open front side 70 and is otherwise closed, and is lined with a light-absorbent material such as velvet 72 which may be black, or other dark color. The glass panel is preferably mounted with the pattern 64 inwardly, and in that case, the pattern is in reverse, for viewing a predetermined picture from the front. This assemblage then forms a completed picture or construction 74. As in the previous modifications, the plastic material 64 is transparent, and preferably dyed to color. Light then reflects from the plastic material, both the front side thereof which is in engagement with the rear surface of the glass panel, and the remote side, in the manner of light reflecting from raindrops.

In the case of the picture 74, the reflection is derived substantially from the glass panel and plastic material 64, to the exclusion of course of the lining of the box. Black absorbent material has the quality of substantially preventing any stray light reflection, so that the viewer can, effectively, only see the glass panel and the pictorial representation. Additionally, black is found most effective as to be most invisible when compared with the glass panel, in contrast to other colors. Because of the transparency of the glass, in this form of the picture, and of the plastic material, light from the rear would shine through the glass and produce undesireable effects, but the box prevents this, and additionally any light that should shine through the glass from the front is absorbed by the black velvet, this preventing any similar bad effects.

FIG. 15 is a face view of the picture 74 including the glass panel 62 and showing pictorial representation 65. As in the previous embodiments, the pictorial representation may be of any design and character.

Figure 16:
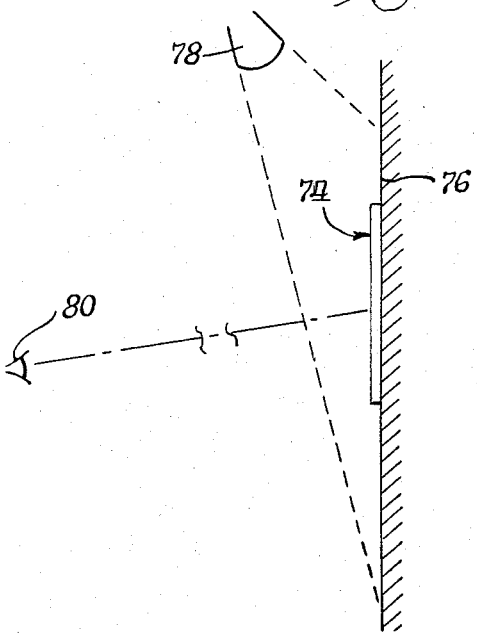

Any of the pictures made according to the foregoing may be mounted on a wall 76 as represented in FIG. 16. A raking light 78 is mounted as on the ceiling, above the picture and at such an angle that glare therefrom does not reach the viewer as indicated at 80. The raking light may be used in association with any of the other pictures of FIGS. 1–4, 5–6 or 7–11, as well as that of FIGS. 12–16. In the case of any of the pictures, there is considerable reflection from the particles of the transparent plastic material, and the position of the light referred to eliminates or greatly reduces glare.

The attached photographs show pictures made according to the invention.

I claim:

1. A picture comprising, a backing member, a foil sheet, continuous, imperforate and impervious, and having regular and uniform surfaces one surface being secured to the backing member in position thereon with its other surface forming a front surface presented to view, the backing member being semi-rigid, and thereby self-sustaining in shape, and the backing member and foil sheet together constituting a semi-rigid panel, the backing member and foil sheet being pre-selected in size to determine the size of the picture to be made, the foil sheet being capable of having depressions formed therein, and the backing member being capable of having depressions formed therein in response to depressions being formed in the front surface of the foil sheet, and both the foil sheet and backing member having depressions therein, resulting in corresponding depressions in the panel, and substances in the depressions contrasting in appearance with the foil sheet, the depressions and thereby the respective substances therein being selectively and individually so dimensioned and proportioned and positioned relative to each other as to form a predetermined picture independently of and separate from that portion of the foil sheet that is devoid of depressions and substances and that constitutes a portion of said front surface.

2. A picture according to claim 1 wherein, said substances are transparent.

3. A picture according to claim 1 wherein, said substances are capable of reflecting light from their outer surface, and from their inner surface where they engage the bottoms of the depressions.

4. A picture according to claim 1 wherein, said substances are of different colors.

5. A picture according to claim 1 wherein, said substances are of plastic material.

6. A picture according to claim 1 wherein, the foil sheet has a reflective character.

7. A picture according to claim 6 wherein, the foil sheet has greater reflectivity in the depressions than on the remainder of its surface.

8. A picture according to claim 1 wherein, said substances have outer convex surfaces extending upwardly beyond the front surface of the foil sheet.

9. A picture according to claim 1 wherein, said substances form discrete quantities as between different depressions and they include different kinds of conformations including size and shape.

10. A picture according to claim 1 wherein, the foil sheet is of metal.

11. A picture according to claim 1 wherein, the backing member is of plastic material yieldable and non-resilient.

12. A picture according to claim 1 wherein, the supporting surface of the backing member, except for the depressions, is continuous and flat, and the foil sheet in place thereon forms a corresponding continuous and flat surface.

13. A picture according to claim 11 wherein, the depressions in the backing member and foil sheet are complementary whereby they interengage substantially throughout their entire area.

14. A picture according to claim 1 wherein, the backing member includes a rear layer and a stencil layer thereover, the stencil layer having openings therein, the foil sheet is superposed over the stencil layer, the portions overlying the openings extend thereinto and thereby form the depressions in the front surface of the foil sheet.

* * * * *